US011859635B2

(12) United States Patent
Tomioka et al.

(10) Patent No.: US 11,859,635 B2
(45) Date of Patent: Jan. 2, 2024

(54) AXIAL-FLOW FAN AND AIR CONDITIONER

(71) Applicant: DAIKIN INDUSTRIES, LTD., Osaka (JP)

(72) Inventors: Hirotaka Tomioka, Osaka (JP); Takahiro Yamasaki, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 0 days.

(21) Appl. No.: 18/355,570

(22) Filed: Jul. 20, 2023

(65) Prior Publication Data

US 2023/0358249 A1 Nov. 9, 2023

Related U.S. Application Data

(63) Continuation of application No. PCT/JP2021/047267, filed on Dec. 21, 2021.

(30) Foreign Application Priority Data

Jan. 21, 2021 (JP) ..... 2021-007660

(51) Int. Cl.
*F04D 29/32* (2006.01)
*F04D 19/00* (2006.01)
*F04D 29/38* (2006.01)

(52) U.S. Cl.
CPC ..... *F04D 29/329* (2013.01); *F04D 19/002* (2013.01); *F04D 29/386* (2013.01)

(58) Field of Classification Search
CPC ..... F04D 29/329; F04D 19/002; F04D 29/386
See application file for complete search history.

(56) References Cited

U.S. PATENT DOCUMENTS

2015/0003992 A1 1/2015 Kojima et al.
2018/0112675 A1* 4/2018 Neff ..... F04D 29/5833

FOREIGN PATENT DOCUMENTS

CN 111075759 A 4/2020
JP H08-121387 A 5/1996
(Continued)

OTHER PUBLICATIONS

English Translation of an International Preliminary Report on Patentability and Written Opinion issued in corresponding International Application No. PCT/JP2021/047267, dated Aug. 3, 2023 (6 pages).

(Continued)

*Primary Examiner* — Aaron R Eastman
(74) *Attorney, Agent, or Firm* — Osha Bergman Watanabe & Burton LLP

(57) ABSTRACT

An axial-flow fan includes: a hub; and blades disposed on an outer peripheral surface of the hub and spaced apart from each other in a circumferential direction. The hub includes: an outer wall having a tubular shape; an inner wall having a tubular shape and being disposed radially inward of the outer wall; a boss to which a shaft is mounted and that is disposed radially inward of the inner wall; a first sidewall connecting an end portion of the outer wall that is closer to a first side in a rotation axis direction of the hub with an end portion of the inner wall that is closer to the first side in the rotation axis direction; and a second sidewall connecting the end portion of the inner wall with an end portion of the boss that is closer to the first side in the rotation axis direction.

10 Claims, 13 Drawing Sheets

(56) References Cited

FOREIGN PATENT DOCUMENTS

| | | | |
|---|---|---|---|
| JP | 2006-161758 | A | 6/2006 |
| JP | 2015-209832 | A | 11/2015 |
| WO | 2013/099905 | A1 | 7/2013 |

OTHER PUBLICATIONS

International Search Report issued in corresponding International Application No. PCT/JP2021/047267 dated Feb. 8, 2022 (2 pages).
Written Opinion issued in corresponding International Application No. PCT/JP2021/047267dated Feb. 8, 2022 (4 pages).
Notice of Reasons for Refusal issued in corresponding Japanese Application No. 2021-007660 dated Feb. 1, 2022 (10 pages).
Decision to Grant a Patent issued in corresponding Japanese Application No. 2021-007660 dated Apr. 5, 2022 (5 pages).

* cited by examiner

AXIAL-FLOW FAN AND AIR CONDITIONER

TECHNICAL FIELD

The present disclosure relates to an axial-flow fan and an air conditioner.

BACKGROUND

Patent Literature 1 listed below discloses an axial-flow fan including a hub and a plurality of blades disposed on an outer peripheral surface of the hub. The hub includes an outer wall portion having a cylindrical shape, a slanted wall portion located radially inward of the outer wall portion, and a bearing portion located radially inward of the slanted wall portion. The hub also includes a plurality of ribs arranged radially. The ribs are located between the outer wall portion and the slanted wall portion, and are spaced apart from each other in a circumferential direction.

PATENT LITERATURE

PATENT LITERATURE 1: Japanese Laid-Open Patent Publication No. 2006-161758

SUMMARY

The present disclosure provides an axial-flow fan including:

a hub; and a plurality of blades disposed on an outer peripheral surface of the hub and spaced apart from each other in a circumferential direction, in which the hub includes:

an outer wall having a tubular shape;

an inner wall having a tubular shape, the inner wall being located radially inward of the outer wall;

a boss to which a shaft is mounted, the boss being located radially inward of the inner wall;

a first sidewall connecting an end portion, closer to a first side in a rotation axis direction of the hub, of the outer wall and an end portion, closer to the first side in the rotation axis direction, of the inner wall;

a second sidewall connecting the end portion, closer to the first side in the rotation axis direction, of the inner wall and an end portion, closer to the first side in the rotation axis direction, of the boss;

a first rib connecting an inner peripheral surface of the inner wall and an outer peripheral surface of the boss;

a second rib adjacent to the first rib in the circumferential direction, the second rib connecting the inner peripheral surface of the inner wall and the outer peripheral surface of the boss; and a third rib connecting an inner peripheral surface of the outer wall and an outer peripheral surface of the inner wall, the third rib having a radially inner end portion located between a radially outer end portion of the first rib and a radially outer end portion of the second rib in the circumferential direction.

DETAILED DESCRIPTION

Embodiments will be described below.

[General Configuration of Axial-Flow Fan]

Figure 1:
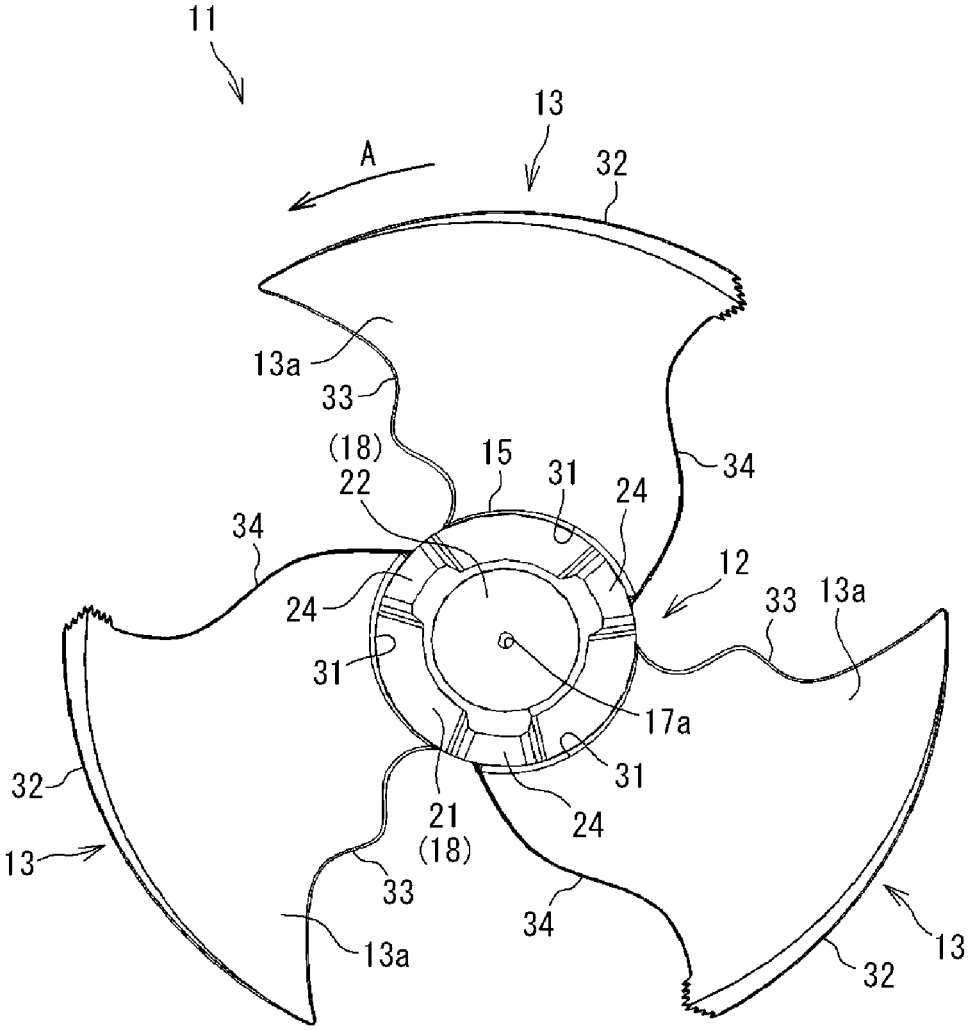
FIG. 1 is a view illustrating an axial-flow fan according to the present disclosure as seen from a first side in a rotation axis direction.
Figure 2:
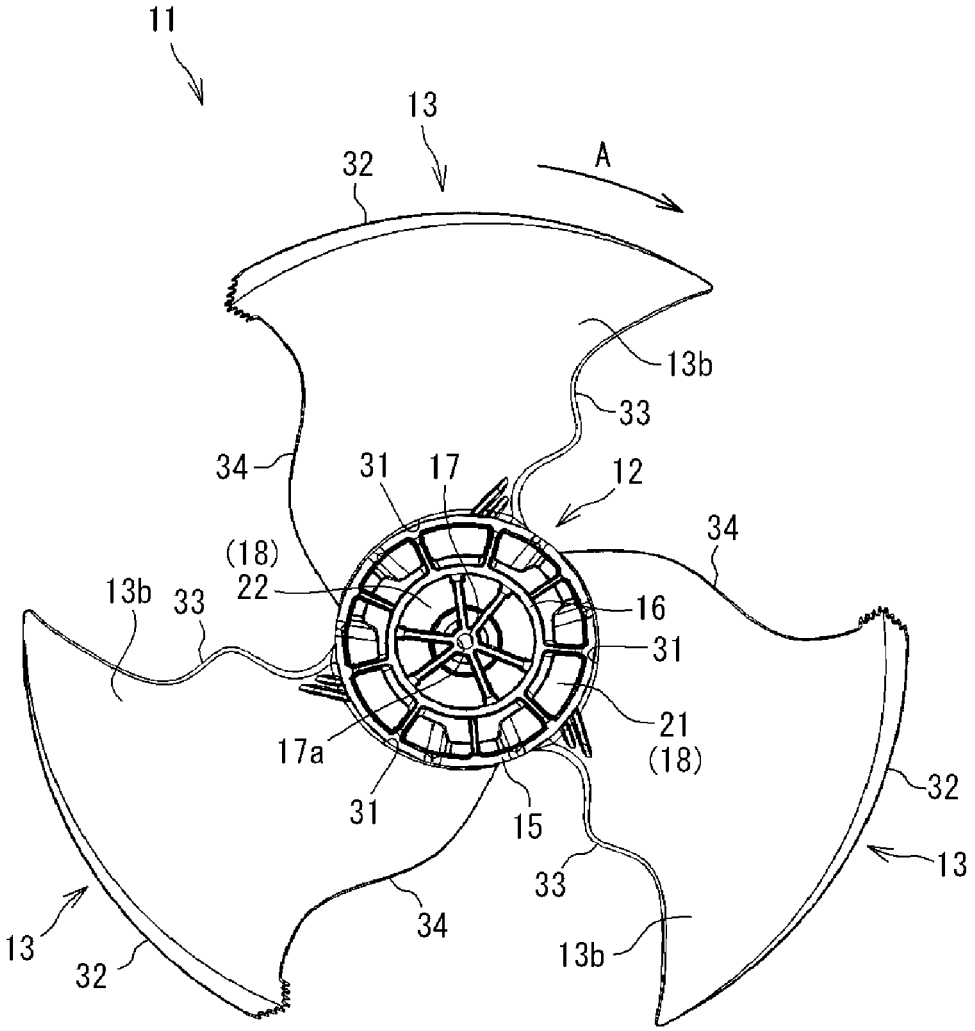
FIG. 2 is a view illustrating the axial-flow fan according to the present disclosure as seen from a second side in the rotation axis direction.
Figure 3:
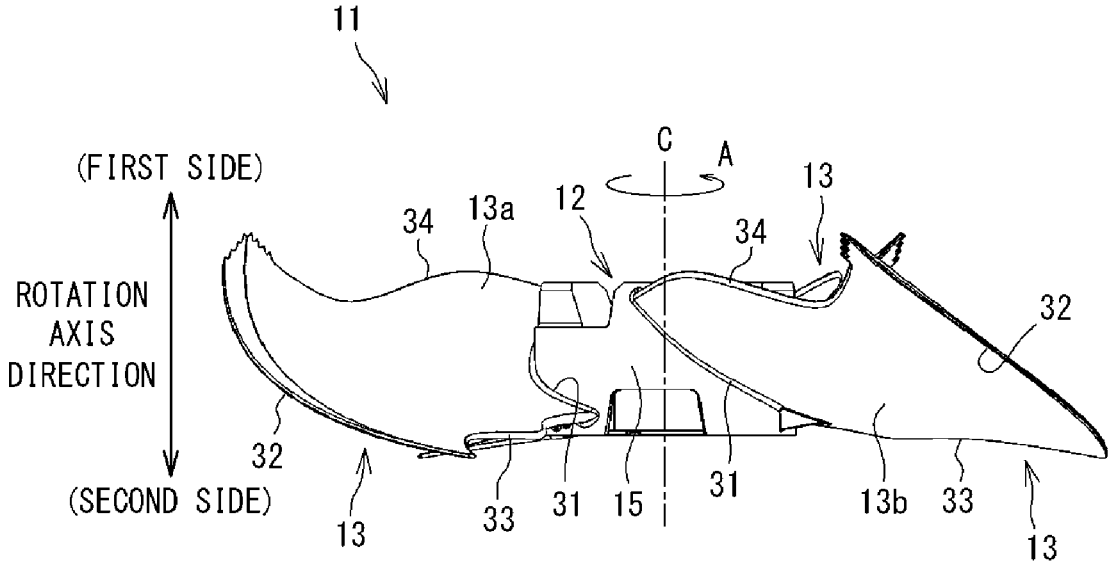
FIG. 3 is a view illustrating the axial-flow fan according to the present disclosure as seen in a direction orthogonal to the rotation axis direction.

FIG. 1 is a view illustrating an axial-flow fan according to the present disclosure as seen from a first side in a rotation axis direction. FIG. 2 is a view illustrating the axial-flow fan according to the present disclosure as seen from a second side in the rotation axis direction. FIG. 3 is a view illustrating the axial-flow fan according to the present disclosure as seen in a direction orthogonal to the rotation axis direction.

An axial-flow fan 11 is driven by a fan motor (not illustrated) to rotate about a center axis C. Accordingly, the center axis C of the axial-flow fan 11 corresponds to an axis of rotation of the axial-flow fan 11. In this specification, therefore, reference sign C also denotes the axis of rotation of the axial-flow fan 11, in addition to the center axis of the axial-flow fan 11. In this specification, the term "rotation axis direction" as used herein refers to a direction along which the center axis C of the axial-flow fan 11 extends and a direction parallel to this direction. The term "radial direction" as used herein refers to a direction orthogonal to the center axis C of the axial-flow fan 11. The term "circumferential direction" as used herein refers to a direction around the center axis C of the axial-flow fan 11.

As illustrated in FIGS. 1 to 3, the axial-flow fan 11 is a propeller fan. The axial-flow fan 11 is made of, for example, a synthetic resin material such as an acrylonitrile-styrene (AS) copolymer, or a synthetic resin material reinforced with glass fiber. The axial-flow fan 11 includes a hub 12 and a plurality of blades 13. The plurality of blades 13 are disposed on an outer peripheral surface of the hub 12, and are spaced apart from each other in the circumferential direction. The axial-flow fan 11 according to one or more embodiments includes three blades 13. The hub 12 and the blades 13 are integrally formed with a synthetic resin material. It should be noted that the material for the axial-flow fan 11 is not limited to the foregoing synthetic resin and is changeable as appropriate.

As illustrated in FIG. 1, the axial-flow fan 11 rotates counterclockwise (i.e., in a direction indicated by an arrow A) as seen from the first side in the rotation axis direction. In this specification, a front side and a rear side in a rotational direction are defined with respect to a rotational direction of the axial-flow fan 11.

[Configuration of Blade]

As illustrated in FIGS. 1 to 3, each blade 13 has a plate shape and includes an inner peripheral edge portion 31, an outer peripheral edge portion 32, a front edge portion 33, and a rear edge portion 34. The inner peripheral edge portion 31 corresponds to a radially inner end portion of the blade 13. The inner peripheral edge portion 31 is slanted to the first side in the rotation axis direction, from the front side in the rotational direction toward the rear side in the rotational direction. The inner peripheral edge portion 31 is connected to the outer peripheral surface of the hub 12.

The outer peripheral edge portion 32 corresponds to a radially outer end portion of the blade 13. The outer peripheral edge portion 32 is slanted to the first side in the rotation axis direction, from the front side in the rotational direction toward the rear side in the rotational direction. The outer peripheral edge portion 32 is longer in circumferential length than the inner peripheral edge portion 31.

The front edge portion 33 corresponds to an end portion, closer to the front side in the rotational direction, of the blade 13. The front edge portion 33 connects an end portion, closer to the front side in the rotational direction, of the inner peripheral edge portion 31 and an end portion, closer to the front side in the rotational direction, of the outer peripheral edge portion 32. The rear edge portion 34 corresponds to an end portion, closer to the rear side in the rotational direction, of the blade 13. The rear edge portion 34 connects an end portion, closer to the rear side in the rotational direction, of the inner peripheral edge portion 31 and an end portion, closer to the rear side in the rotational direction, of the outer peripheral edge portion 32.

The axial-flow fan 11, when rotating about the center axis C in the direction indicated by the arrow A, generates a negative pressure at the second side in the rotation axis direction and also generates a positive pressure at the first side in the rotation axis direction. Therefore, the axial-flow fan 11, when rotating about the center axis C in the direction indicated by the arrow A, causes air to flow from the second side in the rotation axis direction to the first side in the rotation axis direction. In this specification, the term "positive pressure surface 13*a*" refers to a blade surface, closer to the first side in the rotation axis direction, of the blade 13, and the term "negative pressure surface 13*b*" refers to a blade surface, closer to the second side in the rotation axis direction, of the blade 13.

The blade 13 curves gently toward the second side in the rotation axis direction as seen in the circumferential direction such that the positive pressure surface 13*a* is recessed.

[Configuration of Hub]

Figure 4:
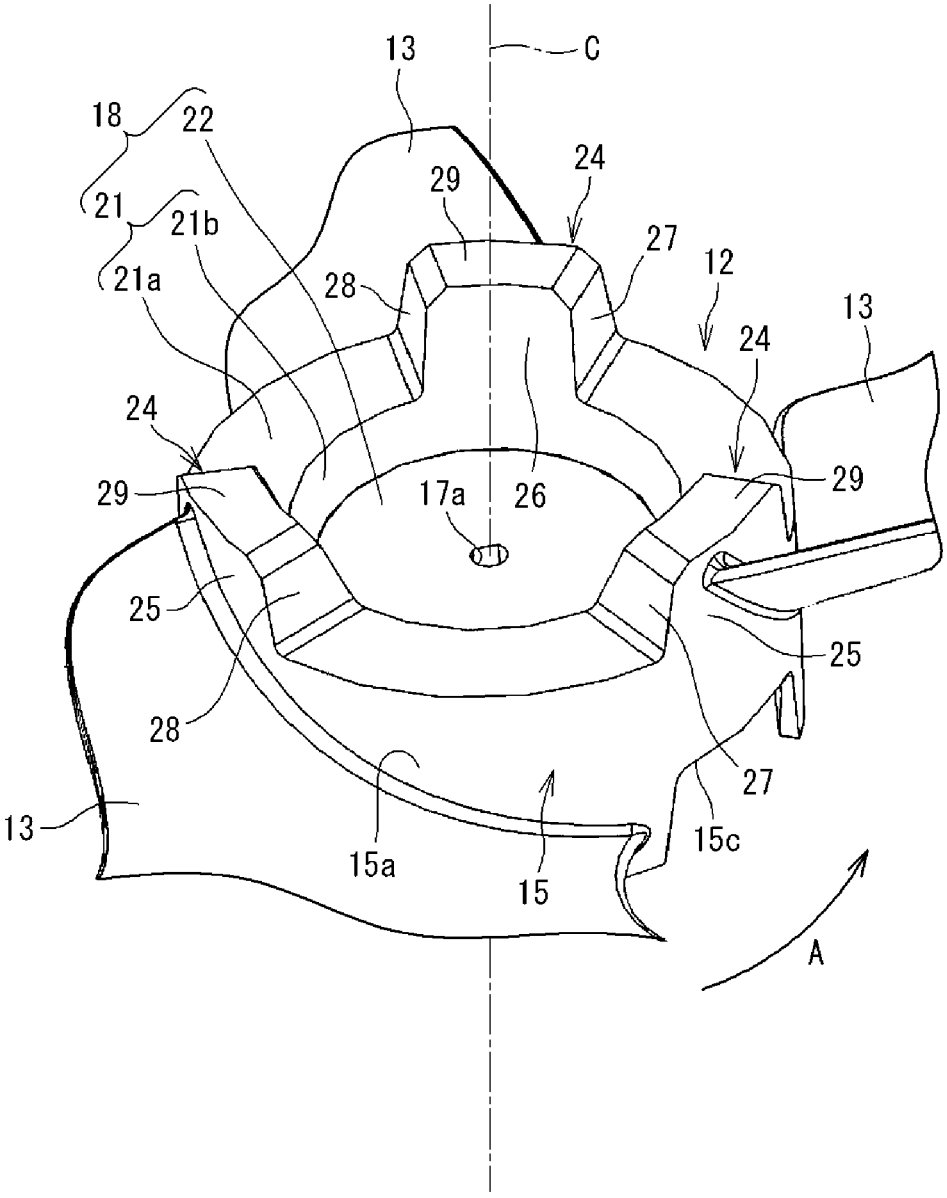
FIG. 4 is a perspective view illustrating a hub of the axial-flow fan as seen obliquely from the first side in the rotation axis direction.
Figure 5:
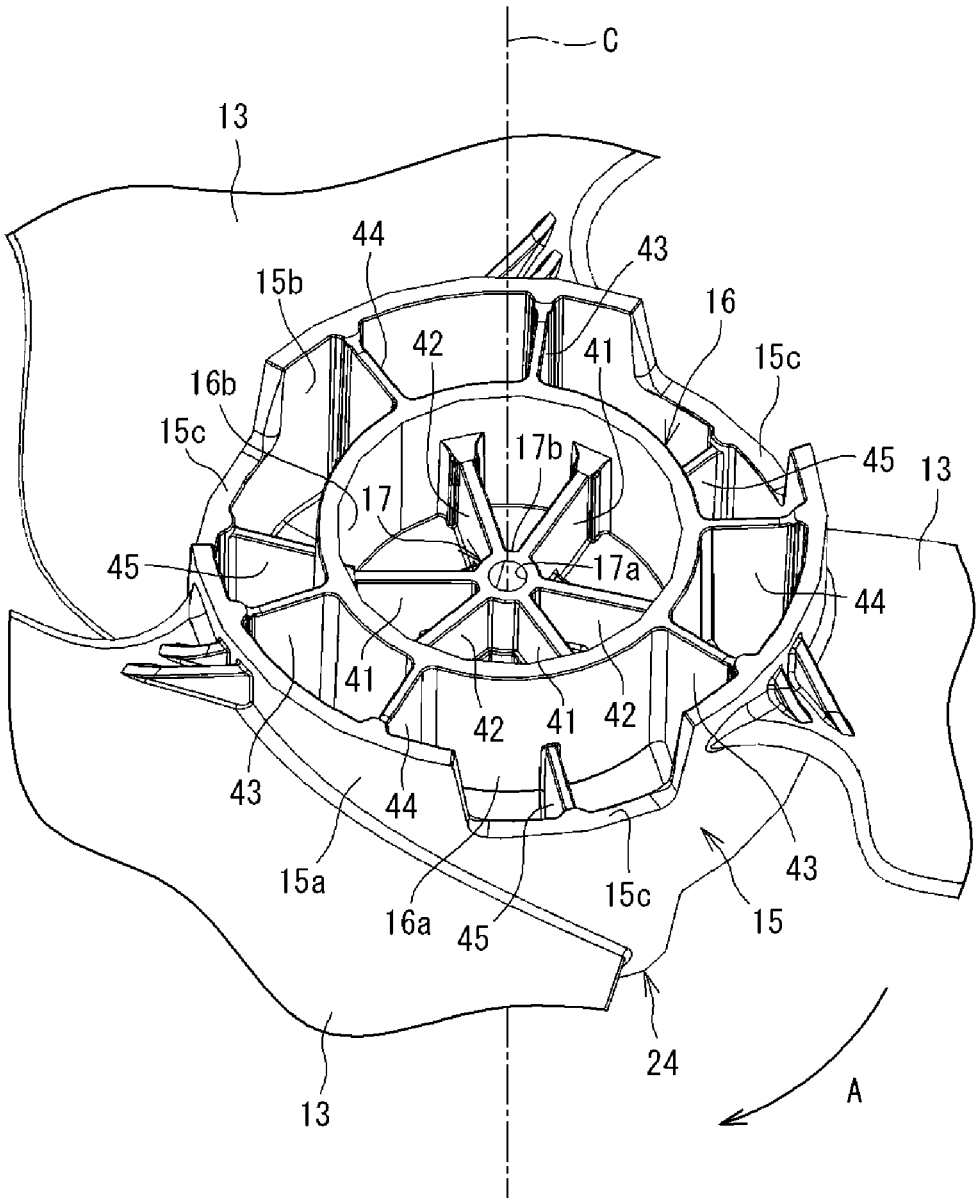
FIG. 5 is a perspective view illustrating the hub of the axial-flow fan as seen obliquely from the second side in the rotation axis direction.
Figure 6:
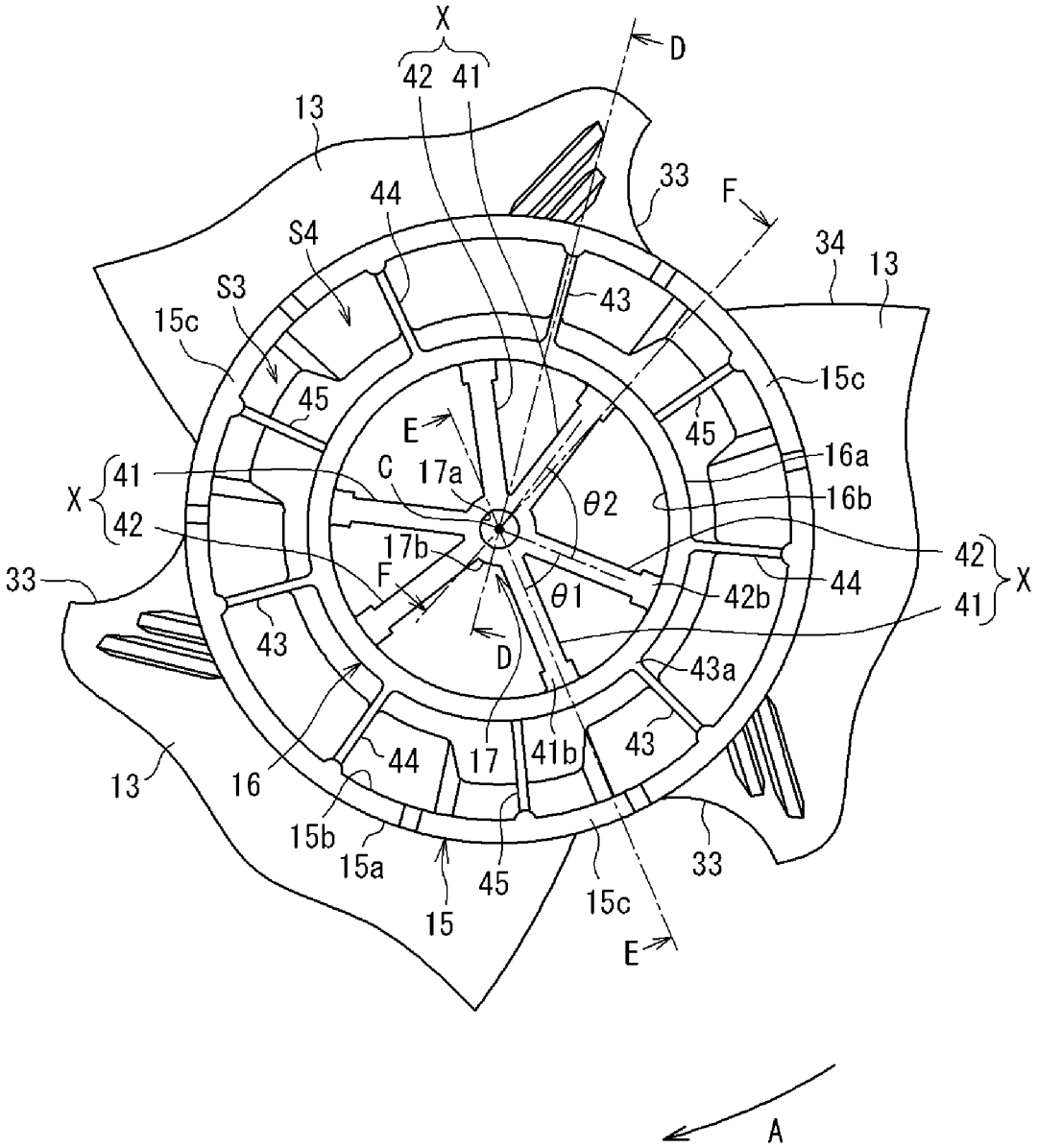
FIG. 6 is a view illustrating the hub of the axial-flow fan as seen from the second side in the rotation axis direction.

FIG. 4 is a perspective view illustrating the hub of the axial-flow fan as seen obliquely from the first side in the rotation axis direction. FIG. 5 is a perspective view illustrating the hub of the axial-flow fan as seen obliquely from the second side in the rotation axis direction. FIG. 6 is a view illustrating the hub of the axial-flow fan as seen from the second side in the rotation axis direction.

The hub 12 has an outer wall 15, an inner wall 16, a boss 17, and a sidewall 18.

The outer wall 15 has a tubular shape. Specifically, the outer wall 15 has a cylindrical shape. The outer wall 15 has a center aligned with the center axis C of the axial-flow fan 11. The outer wall 15 has an outer peripheral surface 15*a* corresponding to the outer peripheral surface of the hub 12. The blades 13 are connected to the outer peripheral surface 15*a* of the outer wall 15.

The inner wall 16 has a tubular shape. Specifically, the inner wall 16 has a cylindrical shape. The inner wall 16 is located radially inward of the outer wall 15. The inner wall 16 has a center aligned with the center of the outer wall 15.

The boss 17 has a tubular shape. Specifically, the boss 17 has a cylindrical shape. The boss 17 is located radially inward of the inner wall 16. The boss 17 has a center aligned with the center of the inner wall 16 and the center of the outer wall 15. The boss 17 has a through hole 17*a* passing through the center of the boss 17. An output shaft of a motor (not illustrated) is inserted in the through hole 17*a* and attached to the boss 17.

Figure 7:
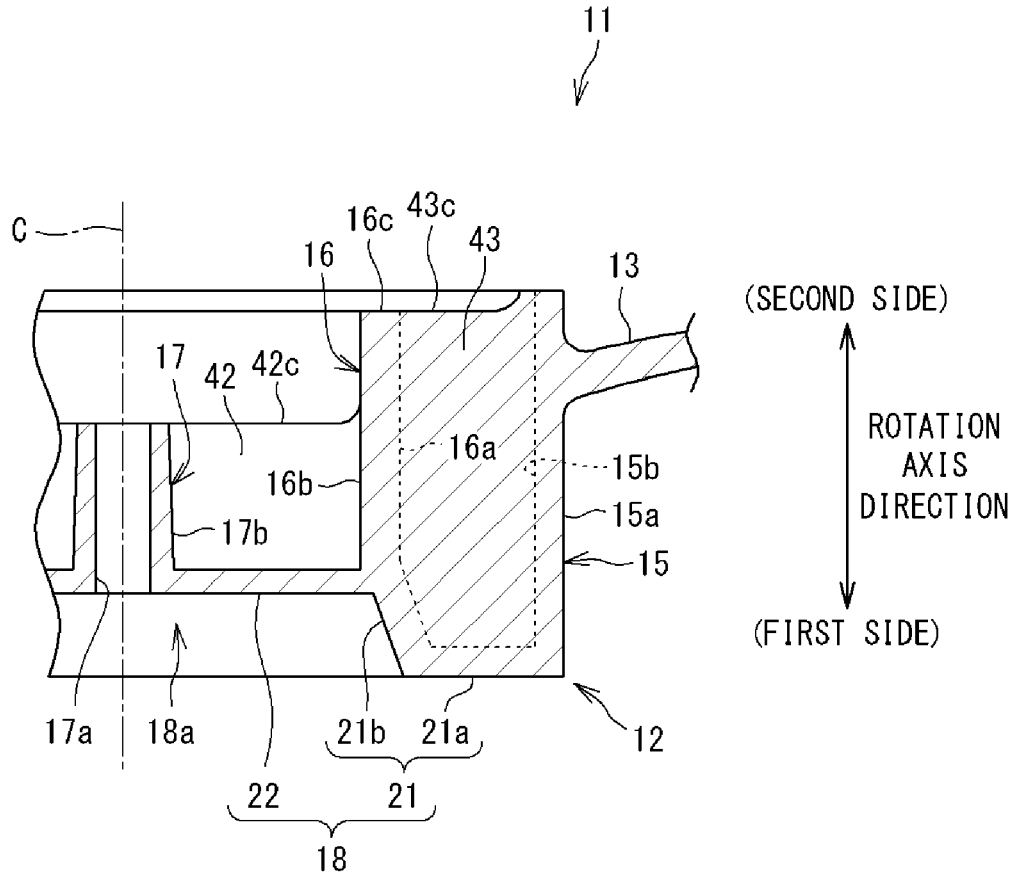
FIG. 7 is a schematic sectional view taken along line D-D in FIG. 6.
Figure 8:
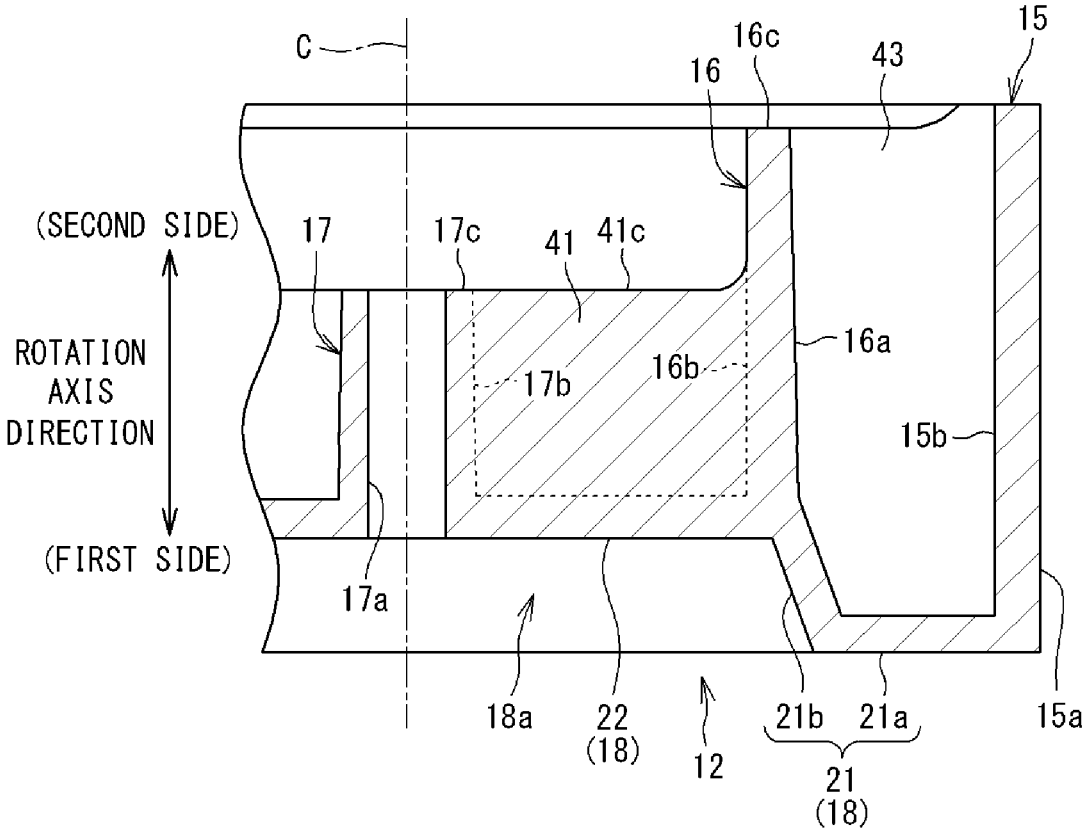
FIG. 8 is a schematic sectional view taken along line E-E in FIG. 6.
Figure 9:
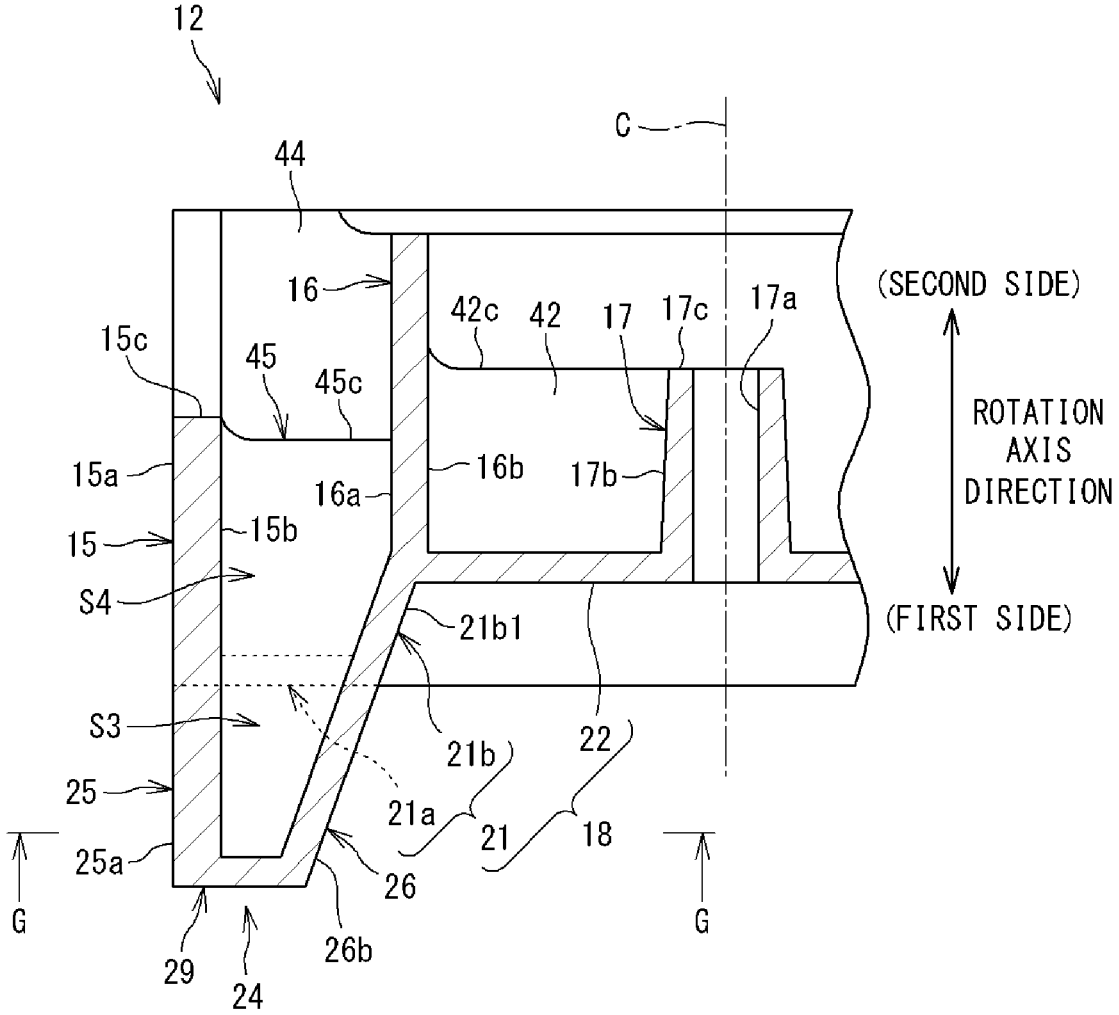
FIG. 9 is a schematic sectional view taken along line F-F in FIG. 6.

FIG. 7 is a schematic sectional view taken along line D-D in FIG. 6. FIG. 8 is a schematic sectional view taken along line E-E in FIG. 6. FIG. 9 is a schematic sectional view taken along line F-F in FIG. 6.

In the hub 12, the inner wall 16 is shorter in axial length than the outer wall 15. An end portion, closer to the first side in the rotation axis direction, of the inner wall 16 is located closer to the second side in the rotation axis direction (e.g., the upper side in FIG. 8) than an end portion, closer to the first side in the rotation axis direction, of the outer wall 15 is. An end portion, closer to the second side in the rotation axis direction, of the inner wall 16 is located closer to the first side in the rotation axis direction (e.g., the lower side in FIG. 8) than an end portion, closer to the second side in the rotation axis direction, of the outer wall 15 is.

In the hub 12, the sidewall 18 is located on the end portions, closer to the first side in the rotation axis direction, of the outer wall 15, inner wall 16, and boss 17. The sidewall 18 closes the end portions, closer to the first side in the rotation axis direction, of the outer wall 15 and inner wall 16 each having a cylindrical shape. The sidewall 18 corresponds to an end surface, closer to the first side in the rotation axis direction, of the hub 12.

The sidewall 18 includes a first sidewall 21 and a second sidewall 22. The first sidewall 21 connects the end portion, closer to the first side in the rotation axis direction, of the outer wall 15 and the end portion, closer to the first side in the rotation axis direction, of the inner wall 16. The second sidewall 22 connects the end portion, closer to the first side in the rotation axis direction, of the inner wall 16 and the end portion, closer to the first side in the rotation axis direction, of the boss 17.

The first sidewall 21 has an annular portion 21*a* and a slanted portion 21*b* located radially inward of the annular portion 21*a*. The annular portion 21*a* has an annular shape, and extends in a direction orthogonal to the center axis C of the axial-flow fan 11. The annular portion 21*a* has a radially outer end portion connected to the end portion, closer to the first side in the rotation axis direction, of the outer wall 15.

The slanted portion 21*b* has a conical shape, and extends obliquely to the center axis C of the axial-flow fan 11. The slanted portion 21*b* has a radially outer end portion connected to a radially inner end portion of the annular portion 21*a*. The slanted portion 21*b* also has a radially inner end portion connected to the end portion, closer to the first side in the rotation axis direction, of the inner wall 16.

The second sidewall 22 has an annular shape, and extends in a direction orthogonal to the center axis C of the axial-flow fan 11. The second sidewall 22 has a radially outer end portion connected to the radially inner end portion of the slanted portion 21*b* and the end portion, closer to the first side in the rotation axis direction, of the inner wall 16. The second sidewall 22 also has a radially inner end portion connected to the end portion, closer to the first side in the rotation axis direction, of the boss 17. The second sidewall 22 closes the end portion, closer to the first side in the rotation axis direction, of the inner wall 16 having a cylindrical shape.

In the hub 12, the sidewall 18 has a recessed portion 18*a* defined by the slanted portion 21*b* and the second sidewall 22 and recessed toward the second side in the rotation axis direction. The slanted portion 21*b* corresponds to a peripheral wall of the recessed portion 18*a*. The second sidewall 22 corresponds to a bottom wall of the recessed portion 18*a*.

In the hub 12, as illustrated in FIG. 4, the sidewall 18 has a protrusion 24 protruding toward the first side in the rotation axis direction. Specifically, the annular portion 21*a* of the first sidewall 21 has the protrusion 24. The annular portion 21*a* has a plurality of protrusions 24 spaced apart from each other in the circumferential direction. In one or more embodiments, three protrusions 24 are equally spaced by 120° apart from each other in the circumferential direction.

Figure 10:
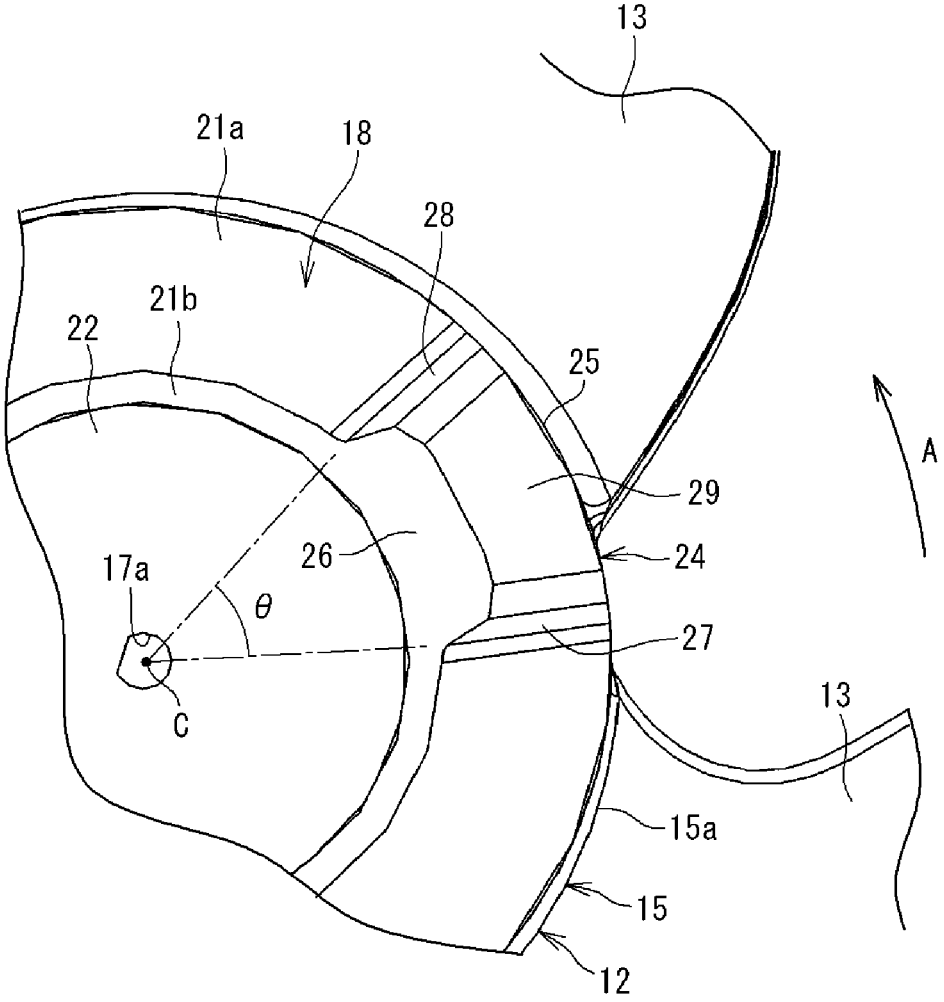
FIG. 10 is a view illustrating a part of the hub of the axial-flow fan as seen from the first side in the rotation axis direction.

FIG. 10 is a view illustrating a part of the hub of the axial-flow fan as seen from the first side in the rotation axis direction. Each protrusion 24 extends within a range of a center angle θ, which is less than 60° , about the center axis C of the axial-flow fan 11.

The protrusion 24 has an outer wall portion (a first wall portion) 25, an inner wall portion (a second wall portion) 26, a pair of end wall portions (a third wall portion and a fourth wall portion) 27 and 28, and a top wall portion (a fifth wall portion) 29.

As illustrated in FIG. 9, the outer wall portion 25 extends from the outer wall 15 of the hub 12, toward the first side in the rotation axis direction. The outer wall portion 25 has an outer peripheral surface 25*a* that is flush with the outer peripheral surface 15*a* of the outer wall 15. The outer wall portion 25 extends in the circumferential direction of the hub 12, and curves in an arc shape as seen in the rotation axis direction.

The inner wall portion 26 of the protrusion 24 extends from the slanted portion 21*b* of the first sidewall 21 of the hub 12, toward the first side in the rotation axis direction. The inner wall portion 26 has an inner peripheral surface 26*b* that is flush with an inner peripheral surface 21*b*1 of the slanted portion 21*b* (i.e., an inner peripheral surface 21*b*1 of the recessed portion 18*a*). The inner wall portion 26 extends obliquely to the center axis C. The inner wall portion 26 extends in the circumferential direction of the hub 12, and curves in an arc shape as seen in the rotation axis direction.

The outer peripheral surface 25*a* of the outer wall portion 25 is connected to an end portion, closer to the rear side in the rotational direction A, of each blade 13 (see FIG. 4). The inner wall portion 26 is located radially inward of the outer wall portion 25, and is spaced apart from the outer wall portion 25. The outer wall portion 25 is located opposite the inner wall portion 26 in the radial direction.

Figure 11:
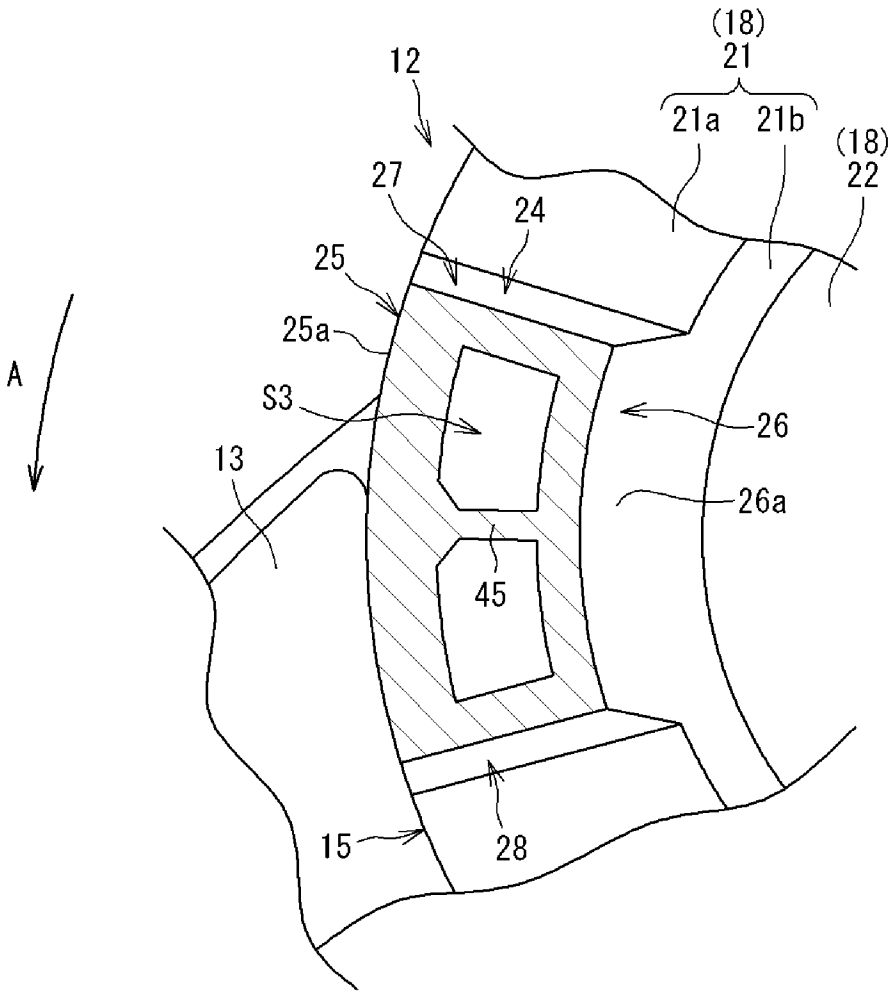
FIG. 11 is a schematic sectional view taken along line G-G in FIG. 9.

FIG. 11 is a schematic sectional view taken along line G-G in FIG. 9.

The pair of end wall portions 27 and 28 are located on two ends of the protrusion 24 so as to face each other in the circumferential direction. The pair of end wall portions 27 and 28 extend in the radial direction of the hub 12. Each of the end wall portions 27 and 28 extends from the annular portion 21*a* of the first sidewall 21, toward the first side in the rotation axis direction. Each of the end wall portions 27 and 28 has such a trapezoidal shape that a radial length, closer to the first side in the rotation axis direction, is shorter. The radial length of each of the end wall portions 27 and 28 is shorter than a circumferential length of each of the outer wall portion 25 and the inner wall portion 26.

The protrusion 24 has a substantially rectangular section orthogonal to the center axis C, and this section is defined by the outer wall portion 25, the inner wall portion 26, and the pair of end wall portions 27 and 28. The protrusion 24 has a space S3 defined by the outer wall portion 25, the inner wall portion 26, and the pair of end wall portions 27 and 28. In other words, the interior of the protrusion 24 is hollow. As illustrated in FIG. 9, the space S3 in the protrusion 24 communicates with a space S4 defined between the outer wall 15 and the inner wall 16 of the hub 12. The space S3 in the protrusion 24 is closed with the top wall portion 29 at the first side in the rotation axis direction. The top wall portion 29 extends in a direction orthogonal to the center axis C of the axial-flow fan 11. A plate-shaped rib (a third outer rib 45) to be described later is located in the space S3 in the protrusion 24. The rib 45 extends from the space S3 in the protrusion 24 toward the second side in the rotation axis direction, and reaches the space S4 in the hub 12.

In the hub 12, as illustrated in FIG. 4, the outer wall 15 has a plurality of recessed portions 15*c*. Specifically, each recessed portion 15*c* is located in the end portion, closer to the second side in the rotation axis direction, of the outer wall 15. Each recessed portion 15*c* is equal in phase to the corresponding protrusion 24 in the circumferential direction.

Figure 12:
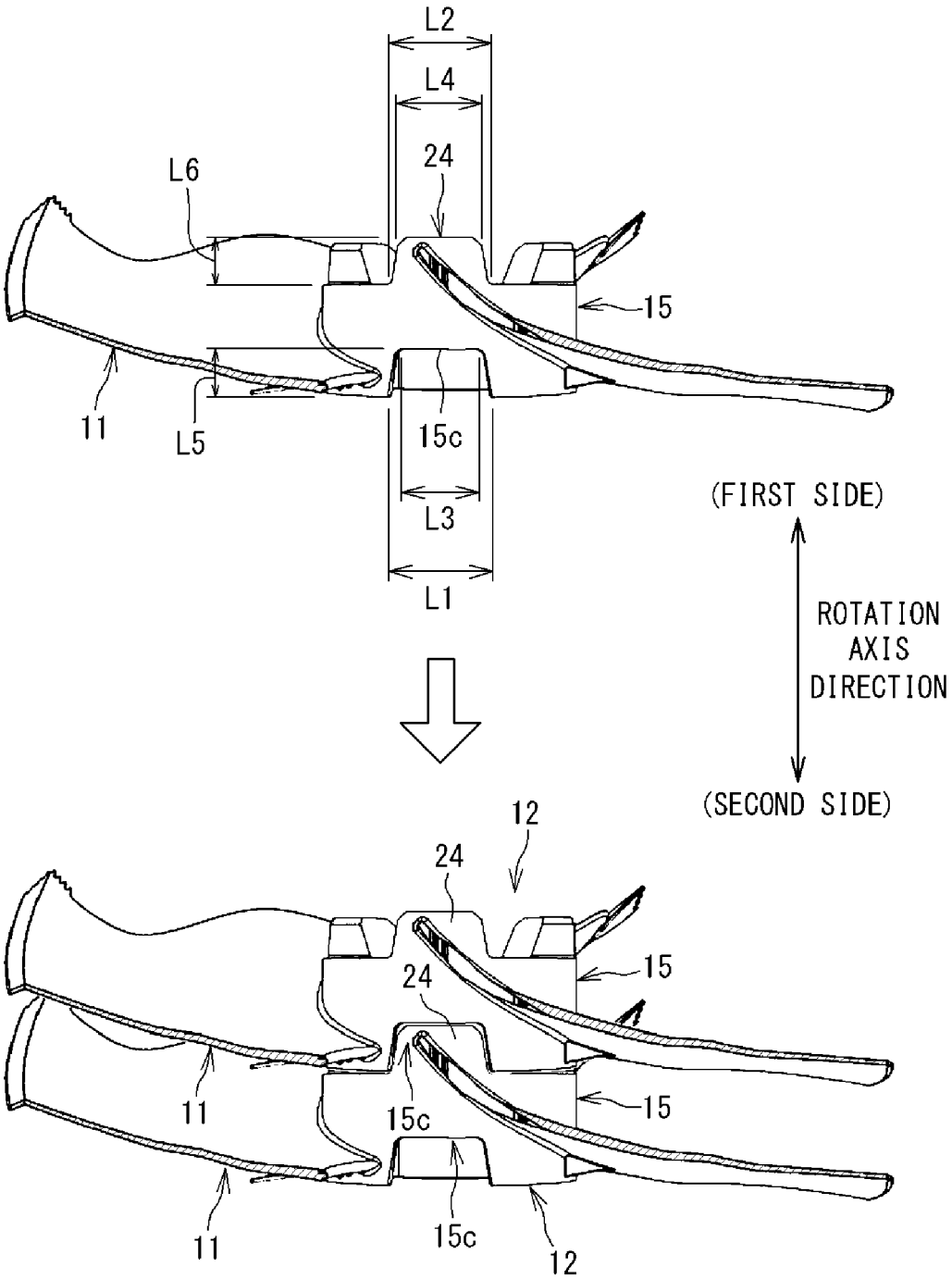
FIG. 12 is an explanatory view illustrating a state in which a plurality of axial-flow fans are stacked on top of each other.

FIG. 12 is an explanatory view illustrating a state in which a plurality of axial-flow fans are stacked on top of each other.

Each recessed portion 15*c* has a trapezoidal shape as seen from the outside in the radial direction. Each protrusion 24 also has a trapezoidal shape as seen from the outside in the radial direction. The recessed portion 15*c* is larger in outside shape than the protrusion 24 as seen from the outside in the radial direction. Specifically, a circumferential length L1 of an open end (i.e., a lower end in FIG. 12) of the recessed portion 15*c* is slightly longer than a circumferential length L2 of a root portion of the protrusion 24. A circumferential length L3 of a bottom portion of the recessed portion 15*c* is slightly longer than a circumferential length L4 of a distal end portion of the protrusion 24. A length (i.e., a depth) L5 of the recessed portion 15*c* in the rotation axis direction is slightly longer than a length (i.e., a height) L6 of the protrusion 24.

The axial-flow fans 11, after manufacture, are stacked in the rotation axis direction for storage and transportation purposes. The protrusion 24 is located on the end surface located closer to the first side in the rotation axis direction of the axial-flow fan 11, and the recessed portion 15*c* is located in the end surface closer to the second side in the rotation axis direction of the axial-flow fan 11. In stacking the plurality of axial-flow fans 11 on top of each other, the protrusion 24 of a lower one of the axial-flow fans 11 is inserted in the recessed portion 15*c* of an upper one of the axial-flow fans 11.

This configuration thus enables reduction in total height of the stacked axial-flow fans 11 in the stacking direction as much as possible. This configuration also enables reduction in circumferential displacement of the axial-flow fans 11 arranged in the stacking direction.

(Configuration of Rib)

As illustrated in FIGS. 5 and 6, the hub 12 has a plurality of ribs 41, 42, 43, 44, and 45. The hub 12 according to one or more embodiments has outer ribs 43, 44, and 45, and inner ribs 41 and 42. The outer ribs 43, 44, and 45 are located between the outer wall 15 and the inner wall 16. The inner ribs 41 and 42 are located between the inner wall 16 and the boss 17. Each of the ribs 41, 42, 43, 44, and 45 has a plate shape and extends in the radial direction from the center axis C of the axial-flow fan 11. Each of the ribs 41, 42, 43, 44, and 45 may alternatively extend in a direction oblique to the radial direction.

The inner ribs 41 and 42 according to one or more embodiments connect an inner peripheral surface 16*b* of the inner wall 16 and an outer peripheral surface 17*b* of the boss 17. The hub 12 has six inner ribs 41 and 42 spaced apart from each other in the circumferential direction. These inner ribs include three first inner ribs 41 and three second inner ribs 42. The first inner ribs 41 and the second inner ribs 42 are arranged alternately in the circumferential direction. Attention is now focused on a certain one of the first inner ribs 41. The first inner rib 41 and the second inner rib 42 adjacent thereto at the first side in the circumferential direction form an angle θ1. In addition, the first inner rib 41 and the second inner rib 42 adjacent thereto at the second side in the circumferential direction form an angle θ2. The angle θ1 and the angle θ2 satisfy a relation of θ1≤θ2.

The first inner rib 41 and the second inner rib 42 that form the angle θ1 constitute a set X. The hub 12 according to one or more embodiments has three sets X respectively constituted of the first inner ribs 41 and the second inner ribs 42. These sets X are spaced apart from each other in the circumferential direction. One of the sets X, which is constituted of the first inner rib 41 and the second inner rib 42, and the adjacent set X, which is constituted of the first inner rib 41 and the second inner rib 42, form the circumferential angle θ2.

The angle θ1 between the first inner rib 41 and the second inner rib 42, which constitute each set X, satisfies the following relation (1):

$$\theta 1 \leq 360/2N(^\circ) \ldots \quad (1)$$

(N: the number of blades 13).

The axial-flow fan 11 according to one or more embodiments includes the three blades 13. Therefore, the angle θ1 satisfies the following relation (2).

$$\theta 1 \leq 60^\circ \ldots \quad (2)$$

The angle θ2 between one of the sets X and the adjacent set X satisfies the following relation (3).

$$\theta 2 \geq 360/2N(^\circ) \ldots \quad (3)$$

The axial-flow fan 11 according to one or more embodiments includes the three blades 13. Therefore, the angle θ2 satisfies the following relation (4).

$$\theta 2 \geq 60^\circ \ldots \quad (4)$$

As illustrated in FIG. 8, an end portion 41*c*, closer to the second side in the rotation axis direction, of each first inner rib 41 and an end portion 17*c*, closer to the second side in the rotation axis direction, of the boss 17 are located at the same position in the rotation axis direction. The end portion 41*c*, closer to the second side in the rotation axis direction, of each first inner rib 41 is located closer to the first side in the rotation axis direction (e.g., the lower side in FIG. 8) than an end portion 16*c*, closer to the second side in the rotation axis direction, of the inner wall 16 is.

The second inner ribs 42 are equal in shape to the first inner ribs 41. Therefore, the positional relationships between each second inner rib 42 and the boss 17 and inner wall 16 in the rotation axis direction are also equal to the positional relationships between each first inner rib 41 and the boss 17 and inner wall 16 in the rotation axis direction.

As illustrated in FIG. 6, the outer ribs 43, 44, and 45 according to one or more embodiments connect an inner peripheral surface 15*b* of the outer wall 15 and an outer peripheral surface 16*a* of the inner wall 16. The hub 12 has nine outer ribs 43, 44, and 45 spaced apart from each other in the circumferential direction. The nine outer ribs 43, 44, and 45 are equally spaced apart from each other in the circumferential direction. The outer ribs 43, 44, and 45 each have a plate shape, and are smaller in thickness than the inner ribs 41 and 42. The inner ribs 41 and 42 are smaller in number than the outer ribs 43, 44, and 45, but are larger in thickness than the outer ribs 43, 44, and 45, which therefore contribute to improvement in strength.

The outer ribs 43, 44, and 45 include three first outer ribs 43, three second outer ribs 44, and three third outer ribs 45. These outer ribs are arranged ordinary. For example, the first outer rib 43, the second outer rib 44, the third outer rib 45, the first outer rib 43, the second outer rib 44, the third outer rib 45, the first outer rib 43, the second outer rib 44, and the third outer rib 45 are arranged in this order in the opposite direction to the rotational direction A.

Of the first outer ribs 43, second outer ribs 44, and third outer ribs 45 arranged as described above, three outer ribs 43, 44, and 45 are provided for each blade 13. The first outer rib 43 has a radially outer end portion located near a radially inner end portion of the front edge portion 33 of the blade 13. The third outer rib 45 has a radially outer end portion located near a radially inner end portion of the rear edge portion 34 of the blade 13. The second outer rib 44 has a radially outer end portion located in correspondence with a middle portion of the blade 13 in the rotational direction A.

As illustrated in FIG. 6, each first outer rib 43 is located between the first inner rib 41 and the second inner rib 42, which constitute the corresponding set X, in the circumferential direction. Specifically, each first outer rib 43 has a radially inner end portion 43*a* located between a radially outer end portion 41*b* of the corresponding first inner rib 41 and a radially outer end portion 42*b* of the corresponding second inner rib 42 in the circumferential direction.

As illustrated in FIG. 7, an end portion 43*c*, closer to the second side in the rotation axis direction, of each first outer rib 43 is located closer to the second side in the rotation axis direction (e.g., the upper side in FIG. 7) than an end portion 42*c*, closer to the second side in the rotation axis direction, of each second inner rib 42 is. The end portion 43*c*, closer to the second side in the rotation axis direction, of each first outer rib 43 is flush with the end portion 16*c*, closer to the second side in the rotation axis direction, of the inner wall 16 at a joint between the first outer rib 43 and the inner wall 16.

The second outer ribs 44 are equal in shape to the first outer ribs 43. Therefore, the positional relationships between each second outer rib 44 and the corresponding first inner rib 41 (and second inner rib 42) and inner wall 16 in the rotation axis direction are equal to the positional relationships between each first outer rib 43 and the corresponding first inner rib 41 (and second inner rib 42) and inner wall 16 in the rotation axis direction.

As illustrated in FIG. 9, each third outer rib 45 is located in the space S3 in the corresponding protrusion 24 as described above. Each third outer rib 45 extends from the space S3 in the corresponding protrusion 24 to the space S4 between the outer wall 15 and the inner wall 16, toward the second side in the rotation axis direction. An end portion

45*c*, closer to the second side in the rotation axis direction, of each third outer rib 45 extends to the slanted portion 21*b* of the first sidewall 21, and reaches the inner wall 16 beyond the slanted portion 21*b*. The end portion 45*c*, closer to the second side in the rotation axis direction, of each third outer rib 45 is located closer to the first side in the rotation axis direction than the bottom portion of the recessed portion 15*c* in the outer wall 15 is. The end portion 45*c*, closer to the second side in the rotation axis direction, of each third outer rib 45 is located closer to the first side in the rotation axis direction than the end portion 42*c*, closer to the second side in the rotation axis direction, of each second inner rib 42 is.

The axial-flow fan 11 having the foregoing configuration generates a centrifugal force by rotation, so that a load traveling through each blade 13 is imposed on the hub 12 to pull the hub 12 radially outward. The hub 12 according to one or more embodiments has the first outer ribs 43, the second outer ribs 44, and the third outer ribs 45. These outer ribs 43, 44, and 45 are capable of supporting the outer wall 15 of the hub 12 against the radial load that travels through each blade 13 and then reaches the outer wall 15.

In particular, when the axial-flow fan 11 rotates, the hub 12 receives the maximum radial load at a position near the front edge portion 33 of each blade 13. As illustrated in FIG. 6, the radially inner end portion 43*a* of each first outer rib 43, which is located near the radially inner end portion of the front edge portion 33 of the corresponding blade 13, is located between the first inner rib 41 and the second inner rib 42, which constitute the corresponding set X, in the circumferential direction. Therefore, the first inner rib 41 and the second inner rib 42 are capable of receiving, together with the first outer rib 43, the large load imposed on the outer wall 15 through the position near the front edge portion 33 of each blade 13, via the inner wall 16. This configuration therefore further improves the strength of the hub 12, and causes the hub 12 to further resist deformation.

The hub 12 also receives, in addition to the radial load, a circumferential load traveling through each blade 13. As illustrated in FIG. 4, the hub 12 has the protrusions 24 on the end surface, closer to the first side in the rotation axis direction, of the hub 12. The protrusions 24 each have the outer wall portion 25 and the inner wall portion 26 each extending in the circumferential direction, and the pair of end wall portions 27 and 28 each extending in the radial direction. The protrusions 24 each have the substantially rectangular section in the direction orthogonal to the center axis C (see FIG. 11). In each protrusion 24, the pair of end wall portions 27 and 28 are capable of causing the hub 12 to resist deformation mainly owing to the radial load imposed on the hub 12. In each protrusion 24, the outer wall portion 25 and the inner wall portion 26 are capable of causing the hub 12 to resist deformation mainly owing to the circumferential load imposed on the hub 12. Therefore, the protrusions 24 allow the hub 12 to have a structure resistant to both the radial load and the circumferential load. The strength of the hub 12 is thus improved.

Each blade 13 is partly connected to the outer wall portion 25 of the corresponding protrusion 24, so that the outer wall portion 25 directly receives the radial load and the circumferential load from the blade 13. However, the protrusion 24 having the substantially rectangular section is capable of properly supporting the outer wall 15 of the hub 12 against these loads.

[Configuration of Air Conditioner]

Figure 13:
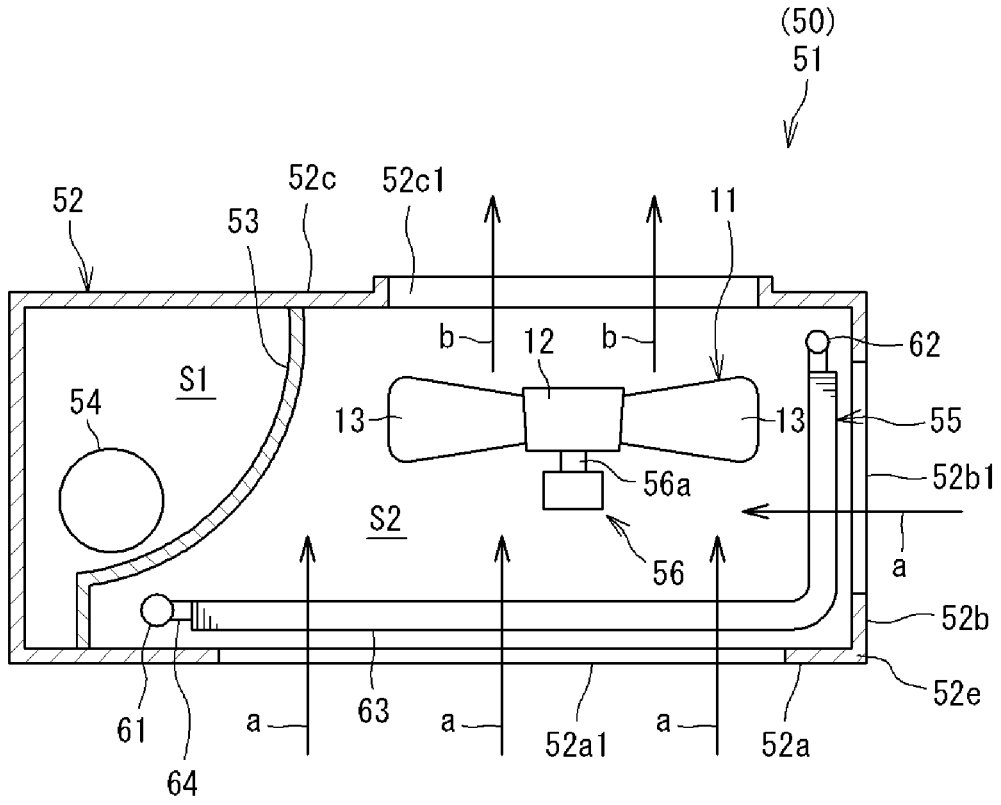
FIG. 13 is a schematic plan view illustrating an inside of an air conditioner including the axial-flow fan according to the present disclosure, as seen from above.

FIG. 13 is a schematic plan view illustrating an inside of an air conditioner including the axial-flow fan according to the present disclosure, as seen from above. FIG. 13 illustrates an outdoor unit 51 of an air conditioner 50. The air conditioner 50 is of a separate type and includes an outdoor unit and an indoor unit provided separately from the outdoor unit. The outdoor unit 51 includes the axial-flow fan 11.

The outdoor unit 51 includes a housing 52. The housing 52 has a rectangular parallelepiped shape. The outdoor unit 51 also includes a partition 53 dividing the housing 52 into a machine chamber S1 and a heat exchange chamber S2. The housing 52 has adjacent sidewalls 52*a* and 52*b* located in the heat exchange chamber S2, and the sidewalls 52*a* and 52*b* respectively have air intake ports 52*a*1 and 52*b*1. The housing 52 also has a sidewall 52*c* adjacent to the sidewall 52*b* having the air intake port 52*b*1, and the sidewall 52*c* has an air blow-out port 52*c*1.

The housing 52 houses, in the machine chamber 51, a compressor 54, a four-way switching valve (not illustrated), an accumulator (not illustrated), an oil separator (not illustrated), an expansion valve (not illustrated), and the like. The housing 52 also houses, in the heat exchange chamber S2, a heat exchanger 55, a fan motor 56, the axial-flow fan 11, and the like. The axial-flow fan 11 is connected to the fan motor 56 with a shaft 56*a*, and is driven by the fan motor 56 to rotate about the shaft 56*a*. The shaft 56*a* is mounted to the boss 17 (see, for example, FIGS. 2, 5) of the axial-flow fan 11.

The axial-flow fan 11 is placed with the positive pressure surface 13*a* (see FIG. 3) facing the sidewall 52*c* having the air blow-out port 52*c*1 and the negative pressure surface 13*b* (see FIG. 3) facing the sidewall 52*a* having the air intake port 52*a*1. When the fan motor 56 operates, the axial-flow fan 11 rotates. Air is thus taken in the housing 52 through the air intake ports 52*a*1 and 52*b*1, and is then blown out of the housing 52 through the air blow-out port 52*c*1. In FIG. 8, arrows "a" each indicate a flow of air taken in the housing 52 through the air intake ports 52*a*1 and 52*b*1, and arrows "b" each indicate a flow of air blown out of the housing 52 through the air blow-out port 52*c*1.

The heat exchanger 55 has an "L" shape in plan view. The heat exchanger 55 bends at a position near a corner portion 52*e* between the sidewalls 52*a* and 52*b* respectively having the air intake ports 52*a*1 and 52*b*1, and extends along the sidewalls 52*a* and 52*b*. The heat exchanger 55 includes a pair of headers 61 and 62, a group of fins 63 arranged side by side such that their plate-shaped faces extend in parallel, and a heat transfer tube 64 passing through the group of fins 63 arranged side by side. A refrigerant, which circulates through a refrigerant circuit, flows into the heat transfer tube 64 of the heat exchanger 55. The heat exchanger 55 is connected to the compressor 54 in the machine chamber S1 with a pipe (not illustrated).

In the air conditioner 50 according to one or more embodiments, the outdoor unit 51 includes the axial-flow fan 11. In an air conditioner according to the present disclosure, alternatively, an indoor unit (not illustrated) may include the axial-flow fan 11. The air conditioner 50 may include the axial-flow fan 11 placed with the axis of rotation extending in an up-and-down direction.

The foregoing embodiments may be at least partially combined with each other in a given manner.

[Action and Effects of Embodiments]

During the rotation of the axial-flow fan, a load traveling through each blade is imposed on the outer wall portion of the hub to pull the hub radially outward. This load causes the outer wall portion of the hub to deform so as to expand radially outward. It has therefore been required to improve the strength of the hub in order to cause the hub to resist deformation. Therefore, one or more embodiments of the present disclosure provide an axial-flow fan including a hub with improved strength, and an air conditioner including the axial-flow fan.

(Action and Effects)

An axial-flow fan 11 according to one or more embodiments includes a hub 12 and a plurality of blades 13 disposed on an outer peripheral surface of the hub 12 and spaced apart from each other in a circumferential direction. The hub 12 includes: an outer wall 15 having a tubular shape; an inner wall 16 having a tubular shape, the inner wall 16 being located radially inward of the outer wall 15; a boss 17 to which a shaft is mounted, the boss 17 being located radially inward of the inner wall 16; a first sidewall 21 connecting an end portion, closer to a first side in an rotation axis direction of the hub 12, of the outer wall 15 and an end portion, closer to the first side in the rotation axis direction, of the inner wall 16; a second sidewall 22 connecting the end portion, closer to the first side in the rotation axis direction, of the inner wall 16 and an end portion, closer to the first side in the rotation axis direction, of the boss 17; a first inner rib (a first rib) 41 connecting an inner peripheral surface of the inner wall 16 and an outer peripheral surface of the boss 17; a second inner rib (a second rib) 42 adjacent to the first inner rib 41 in the circumferential direction, the second inner rib 42 connecting the inner peripheral surface of the inner wall 16 and the outer peripheral surface of the boss 17; and a first outer rib (a third rib) 43 connecting an inner peripheral surface of the outer wall 15 and an outer peripheral surface of the inner wall 16. The first outer rib 43 has a radially inner end portion located between a radially outer end portion of the first inner rib 41 and a radially outer end portion of the second inner rib 42 in the circumferential direction.

When the axial-flow fan 11 rotates, a load traveling through each blade 13 is imposed on the outer wall 15 of the hub 12 to pull the hub 12 radially outward. The outer wall 15 of the hub 12 is supported by the first outer rib 43, and is further supported by the first inner rib 41 and the second inner rib 42 through the inner wall 16. This configuration thus allows the hub 12 to have a structure resistant to the radial load, and causes the hub 12 to resist deformation.

The radially inner end portion of the single first outer rib 43 is located between the radially outer end portion of the first inner rib 41 and the radially outer end portion of the second inner rib 42 in the circumferential direction. Therefore, the single first outer rib 43 can be reinforced with the first inner rib 41 and second inner rib 42.

The first outer rib 43 has a radially outer end portion located near a radially inner end portion of a front edge portion 33 of each blade 13 in a rotational direction A of the hub 12. The front edge portion 33 of each blade 13 in the rotational direction of the hub 12 corresponds to a portion where the maximum load resulting from air is imposed. In addition, the load imposed on the outer wall 15 of the hub 12 through each blade 13 also increases at the position near the radially inner end portion of the front edge portion 33 of each blade 13. In view of this, the radially outer end portion of the first outer rib 43 is located near the radially inner end portion of the front edge portion 33 of each blade 13. This configuration thus enables effective improvement in strength of the hub 12 at the portion where the large load is imposed through each blade 13.

The first inner rib 41 and the second inner rib 42 are arranged in the radial direction of the hub 12, and an angle between the first inner rib 41 and the second inner rib 42 satisfies the following relation (1):

$$\theta \leq 360/2N \ldots \quad (1)$$

(where θ represents the angle between the first rib and the second rib, and N represents the number of blades).

If the angle between the first inner rib 41 and the second inner rib 42 is too large, there is a possibility of reduction in effect of supporting the first outer rib 43 in the radial direction. In view of this, a spacing between the first inner rib 41 and the second inner rib 42 may be set to satisfy the foregoing relation (1).

The hub 12 includes: a first set X including a combination of the first inner rib 41 and the second inner rib 42; and a second set X including a combination of the first inner rib 41 and the second inner rib 42 that are different from the first inner rib 41 and the second inner rib 42 in the first set X, the second set X being adjacent to the first set X in the circumferential direction. An angle between the first set X and the second set X is larger than an angle between the first inner rib 41 and the second inner rib 42 in each of the first set X and the second set X. According to this configuration, the first outer rib 43 can be effectively reinforced with the first inner rib 41 and the second inner rib 42 in each set X.

The hub 12 according to the foregoing embodiments further includes a third outer rib (a fourth rib) 45 located between the first set X and the second set X in the circumferential direction, the third outer rib 45 connecting the inner peripheral surface 15*b* of the outer wall 15 and the outer peripheral surface 16*a* of the inner wall 16. The third outer rib 45 has a radially outer end portion located near a radially inner end portion of a rear edge portion 34 of each blade 13 in the rotational direction A of the hub 12. According to this configuration, when a load is applied to the outer wall 15 through the position near the rear edge portion 34 of each blade 13 so as to pull the outer wall 15 radially outward, the outer wall 15 is supported by the third outer rib 45, so that the strength of the hub 12 can be improved.

While various embodiments have been described herein above, it is to be appreciated that various changes in form and detail may be made without departing from the spirit and scope presently or hereafter claimed.

For example, the number of outer ribs is not limited to that described in the foregoing embodiments, and is changeable as appropriate. For example, a plurality of second outer ribs 44 may be disposed between each first outer rib 43 and the adjacent third outer rib 45. Alternatively, no second outer rib 44 may be disposed between each first outer rib 43 and the adjacent third outer rib 45. In addition, the number of inner ribs is not limited to that described in the foregoing embodiments, and is changeable as appropriate. The number of sets corresponding to the combinations of the first inner ribs and the second inner ribs is changeable in accordance with the number of blades 13. Two or more outer ribs may be disposed between the first inner rib and the second inner rib that constitute each set.

The sidewall 18 of the hub 12 does not necessarily have the recessed portion 18*a*. The number of protrusions 24 is changeable as appropriate in accordance with the number of blades 13.

Although the disclosure has been described with respect to only a limited number of embodiments, those skilled in the art, having benefit of this disclosure, will appreciate that various other embodiments may be devised without departing from the scope of the present disclosure. Accordingly, the scope of the disclosure should be limited only by the attached claims.

REFERENCE SIGNS LIST

11 axial-flow fan
12 hub

13 blade
15 outer wall
15*a* outer peripheral surface
15*b* inner peripheral surface
16 inner wall
16*a* outer peripheral surface
16*b* inner peripheral surface
16*c* end portion
17 boss
17*b* outer peripheral surface
17*c* end portion
18 sidewall
21 first sidewall
22 second sidewall
33 front edge portion
34 rear edge portion
41 first inner rib (first rib)
41*b* radially outer end portion
41*c* end portion
42 second inner rib (second rib)
42*b* radially outer end portion
42*c* end portion
43 first outer rib (third rib)
43*a* radially inner end portion
43*c* end portion
45 third outer rib (fourth rib)
50 air conditioner
A rotational direction

What is claimed is:

1. An axial-flow fan comprising:
a hub; and
blades disposed on an outer peripheral surface of the hub and spaced apart from each other in a circumferential direction, wherein
the hub comprises:
an outer wall having a tubular shape;
an inner wall having a tubular shape and being disposed radially inward of the outer wall;
a boss to which a shaft is mounted and that is disposed radially inward of the inner wall;
a first sidewall connecting an end portion of the outer wall that is closer to a first side in a rotation axis direction of the hub with an end portion of the inner wall that is closer to the first side in the rotation axis direction;
a second sidewall connecting the end portion of the inner wall with an end portion of the boss that is closer to the first side in the rotation axis direction;
a first rib connecting an inner peripheral surface of the inner wall with an outer peripheral surface of the boss;
a second rib adjacent to the first rib in the circumferential direction and that connects the inner peripheral surface of the inner wall with the outer peripheral surface of the boss; and
a third rib connecting an inner peripheral surface of the outer wall with an outer peripheral surface of the inner wall and that has a radially inner end portion disposed between a radially outer end portion of the first rib and a radially outer end portion of the second rib in the circumferential direction, wherein
the first rib and the second rib are disposed in a radial direction of the hub, and
an angle θ between the first rib and the second rib satisfies $\theta \leq 360/2N$ where N represents a number of the blades, and
the hub further comprises:
a first set including a combination of the first rib and the second rib; and
a second set including a combination of the first rib and the second rib that are different from the first rib and the second rib in the first set and that is adjacent to the first set in the circumferential direction, and
an angle between the first set and the second set is larger than an angle between the first rib and the second rib in each of the first set and the second set.

2. The axial-flow fan according to claim 1, wherein the radially inner end portion of the single third rib is disposed between the radially outer end portion of the first rib and the radially outer end portion of the second rib in the circumferential direction.

3. The axial-flow fan according to claim 1, wherein the third rib has a radially outer end portion disposed near a radially inner end portion of a front edge portion of each of the blades in a rotational direction of the hub.

4. The axial-flow fan according to claim 1, wherein
the hub further comprises:
a fourth rib disposed between the first set and the second set in the circumferential direction that connects the inner peripheral surface of the outer wall with the outer peripheral surface of the inner wall.

5. The axial-flow fan according to claim 4, wherein the fourth rib has a radially outer end portion disposed near a radially inner end portion of a rear edge portion of each of the blades in a rotational direction of the hub.

6. The axial-flow fan according to claim 1, wherein end portions of the first and second ribs that are closer to a second side in the rotation axis direction are disposed closer to the first side in the rotation axis direction than an end portion of the third rib that is closer to the second side in the rotation axis direction is.

7. The axial-flow fan according to claim 1, wherein end portions of the first and second ribs that are closer to a second side in the rotation axis direction are disposed closer to the first side in the rotation axis direction than an end portion of the inner wall that is closer to the second side in the rotation axis direction is.

8. The axial-flow fan according to claim 1, wherein an end portion of the third rib that is closer to a second side in the rotation axis direction is flush with an end portion of the inner wall that is closer to the second side in the rotation axis direction at a joint between the third rib and the inner wall.

9. The axial-flow fan according to claim 1, wherein the first rib and the second rib are larger in thickness than the third rib.

10. An air conditioner comprising the axial-flow fan according to claim 1.

* * * * *